US005687666A

United States Patent [19]

Thoresen

[11] Patent Number: 5,687,666

[45] Date of Patent: Nov. 18, 1997

[54] DEVICE FOR THE MAST OF A SAILBOAT

[76] Inventor: Per-Gunnar Thoresen, P.O. Box 122, N-3061 Svelvik, Norway

[21] Appl. No.: 669,345

[22] PCT Filed: Jan. 2, 1995

[86] PCT No.: PCT/NO95/00002

§ 371 Date: Jun. 28, 1996

§ 102(e) Date: Jun. 28, 1996

[87] PCT Pub. No.: WO95/18744

PCT Pub. Date: Jul. 13, 1995

[30] Foreign Application Priority Data

Jan. 4, 1994 [NO] Norway ..... 940016

[51] Int. Cl.[6] ..... B63B 15/00

[52] U.S. Cl. ..... 114/90; 114/107

[58] Field of Search ..... 114/39.1, 90, 89, 114/102, 103, 104–107, 112

[56] References Cited

U.S. PATENT DOCUMENTS

| | | | |
|---|---|---|---|
| 3,345,969 | 10/1967 | Purvis . | |
| 4,149,482 | 4/1979 | Hoyt | 114/106 |
| 4,930,434 | 6/1990 | Clausin | 114/106 |
| 4,949,660 | 8/1990 | Despries et al. | 114/106 |

FOREIGN PATENT DOCUMENTS

| | | | |
|---|---|---|---|
| 0076878 | 7/1986 | European Pat. Off. . | |
| 2516045 | 5/1983 | France . | |
| 2636299 | 3/1990 | France | 114/106 |
| 3120472 | 7/1988 | Germany . | |
| 365 768 | 4/1974 | Sweden . | |
| 2096961 | 10/1982 | United Kingdom . | |
| 2113636 | 8/1983 | United Kingdom . | |

*Primary Examiner*—Edwin L. Swinehart
*Attorney, Agent, or Firm*—Patterson & Keough, P.A.

[57] ABSTRACT

A main sail's mast rope is inserted into a hollow profile, which is aerodynamically designed and hinged by at least one ring around a substantially round mast. The profile can rotate around the mast about 90° on each side. The shape and function of the profile provide an ideal flow curve for air flow over the mast, profile and sail. The inside of the profile can be designed for roller reefing where the sail is rolled up on a stay provided inside the profile.

20 Claims, 5 Drawing Sheets

DEVICE FOR THE MAST OF A SAILBOAT

BACKGROUND OF THE INVENTION

Field of the Invention

The invention concerns a design of a mast for a sailboat, wherein the mainsail's mast rope is inserted into a hollow profile on the outside of the mast.

In most existing mast designs the position of the mast profile in front of the plane of the sail causes turbulence or the creation of a back eddy over the sail's lee side. Wing sail rigs with a rotating mast have almost no turbulence, since their aerodynamic design is very good, but this rig is only suitable for multi-hull boats. The field of turbulence is extremely wide and extends over the entire height of the sail, and turbulence in this area results in very poor tractive power for this part of the sail. The aerodynamic conditions are highly unsatisfactory.

SUMMARY OF THE INVENTION

The object of the invention is to improve these conditions and thereby provide increased power to the mainsail of a Bermuda-rigged sailboat.

By means of the solution according to the invention an aerodynamic design is obtained which is close to ideal. The field of turbulence is completely eliminated and the construction provides full tractive power over the sail, and in addition tractive power over the actual mast construction up to the foremost point on the mast. The construction approaches the most ideal aerodynamic design, the bird's wing shape.

The construction consists of a round mast tube about which an aerodynamically shaped profile can rotate within a sector of 180 degrees, and inside which are various fastening alternatives for the mainsail, in which roller reefing on the inside of the profile is a possibility. This a further advantage which is achieved with the special design according to the invention.

BRIEF DESCRIPTION OF THE DRAWINGS

The invention will now be described in more detail by means of an embodiment which is illustrated in the drawing.

DETAILED DESCRIPTION OF PREFERRED EMBODIMENTS

Figure 1:
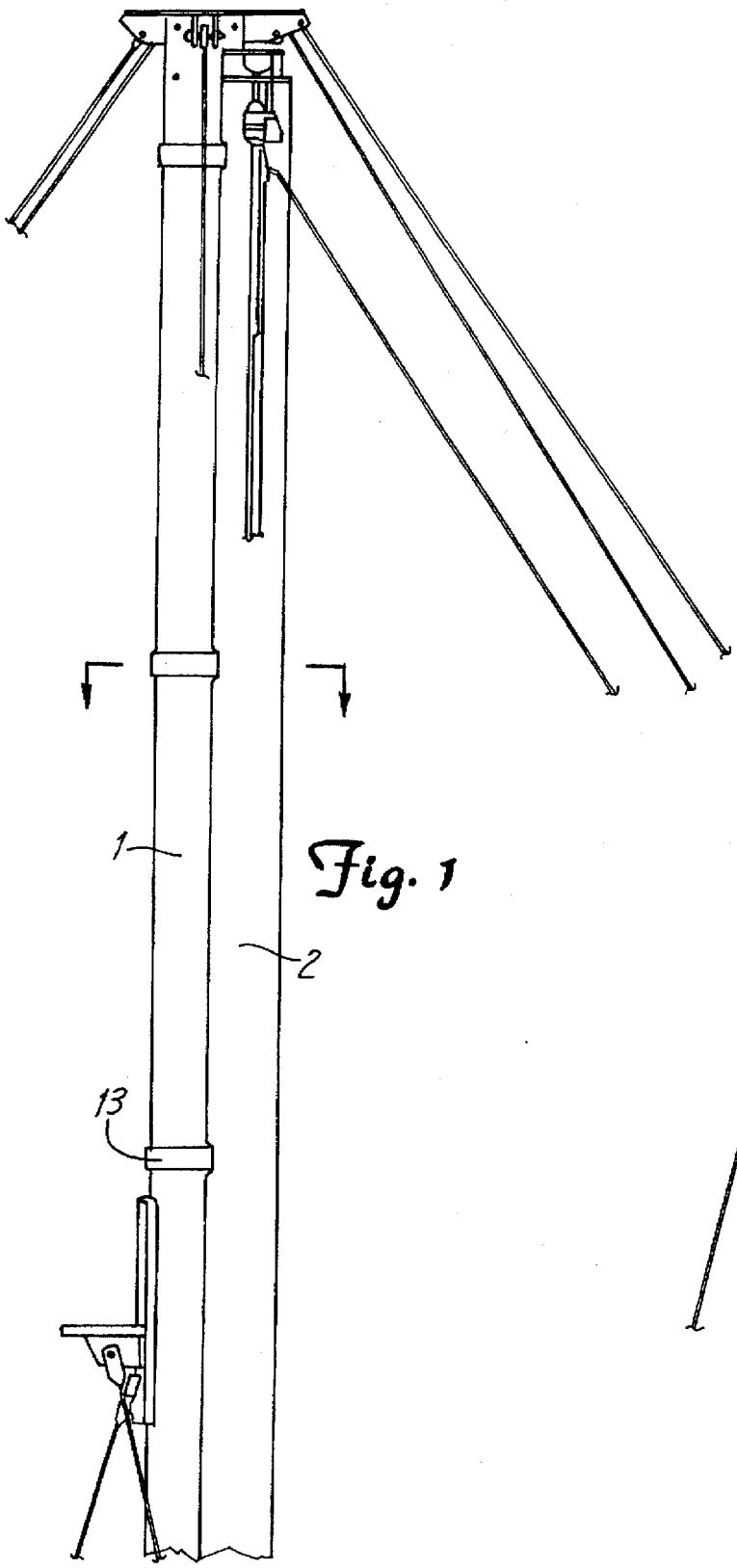
FIG. 1 is a side view of the uppermost part of a mast designed according to the invention.

The mast design is illustrated in the drawing where FIG. 1 shows a side view of the mast's 1 uppermost part down to and including the fastening device for shroud and horns of the crosstrees. The horns of the crosstrees are only shown as a cross section where they are situated in the centre of the bracket. The uppermost part of the profile is illustrated in a "transparent" manner, the roller stay and the attachment of the sail being visible, since this version of the profile is designed internally for a roller mainsail.

Figure 2:
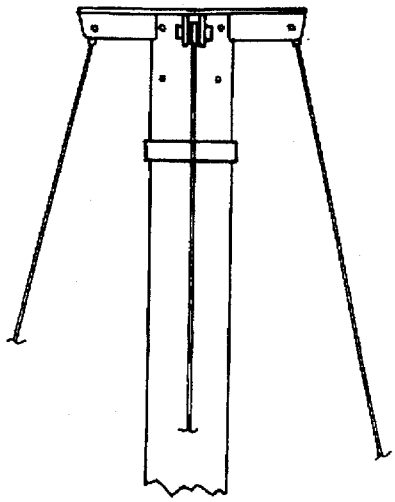
FIG. 2 is a detail drawing of the top of the mast viewed from in front.

FIG. 2 illustrates the top of the mast viewed from in front. The top shrouds are attached to a transverse beam in order to provide space for the rotation of the profile.

Figure 3:
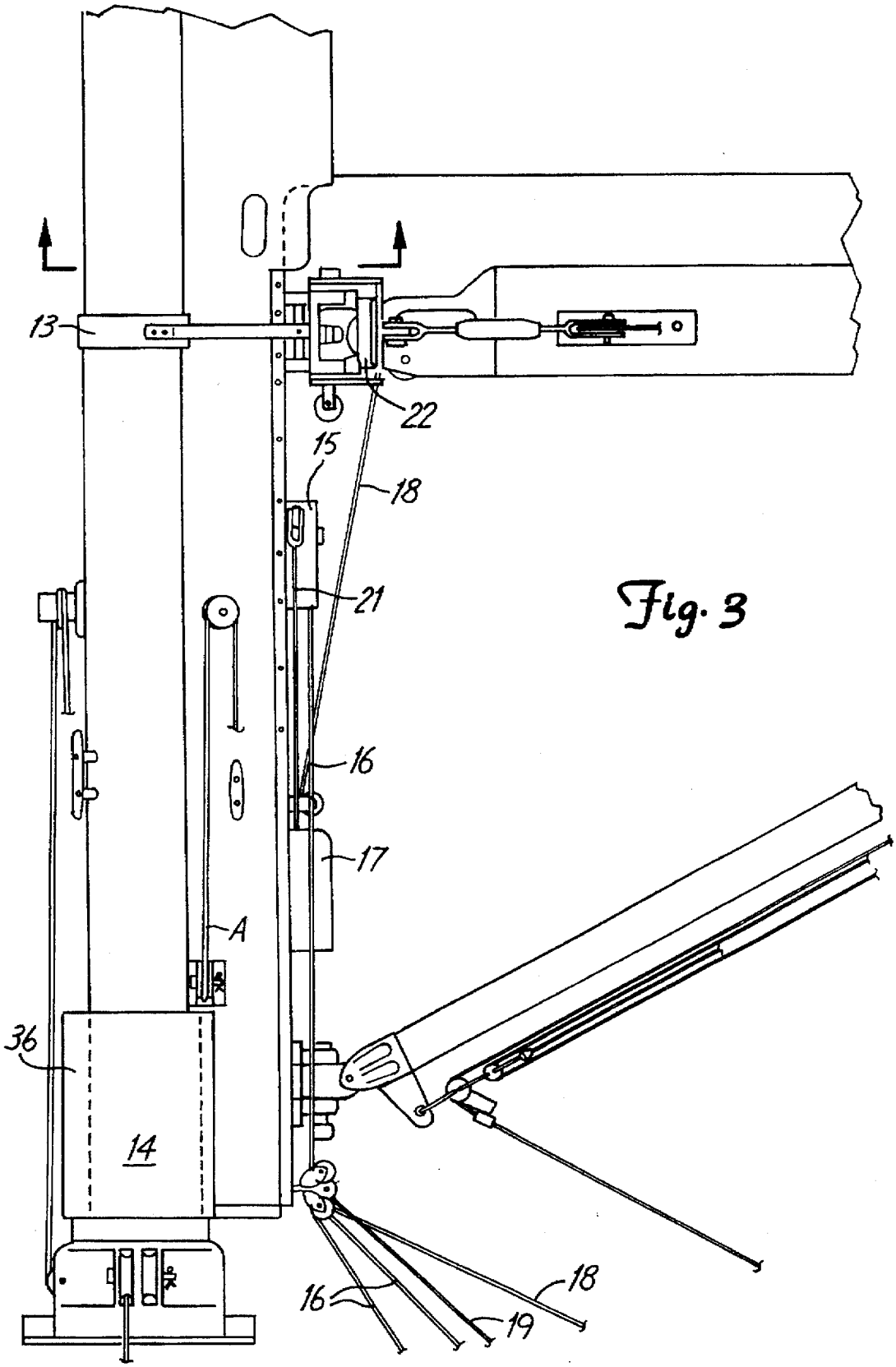
FIG. 3 is a side view of the lower part of the mast.

FIG. 3 illustrates a side view of the lower part of the mast from the neck of the sail down to the attachment on deck. Details will be presented in the following description.

Figure 4:
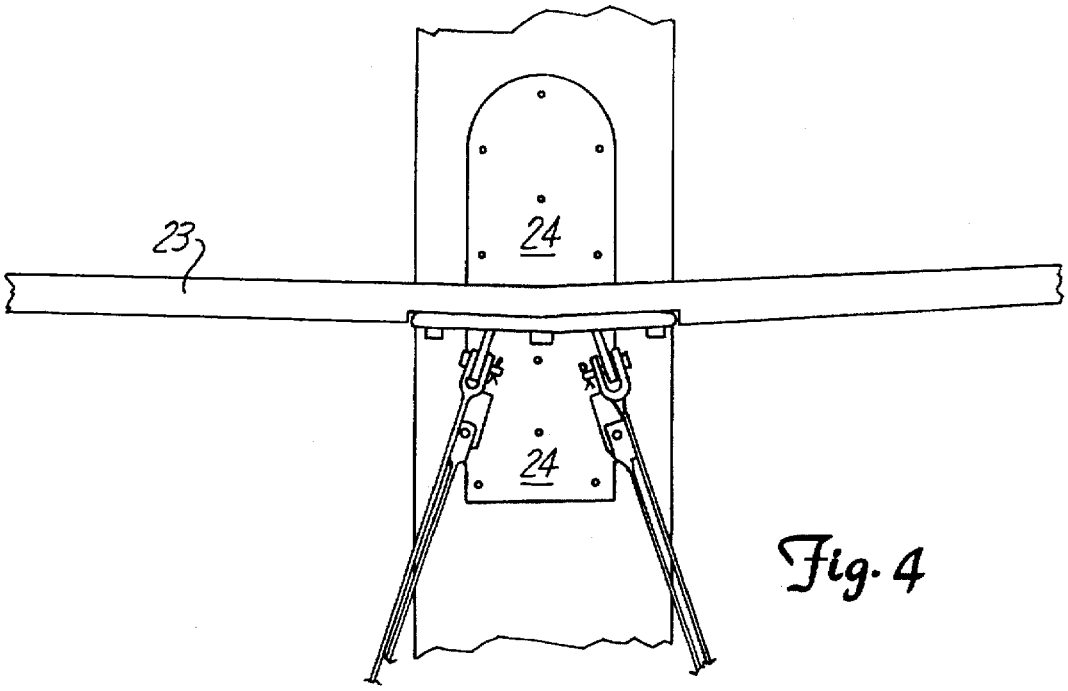
FIG. 4 is a view from in front of the mast with a fastening device for shroud and horns of the crosstrees.

FIG. 4 is a view from in front on an enlarged scale of the fastening device 24 for shroud and horns of the crosstrees 23.

Figure 5:
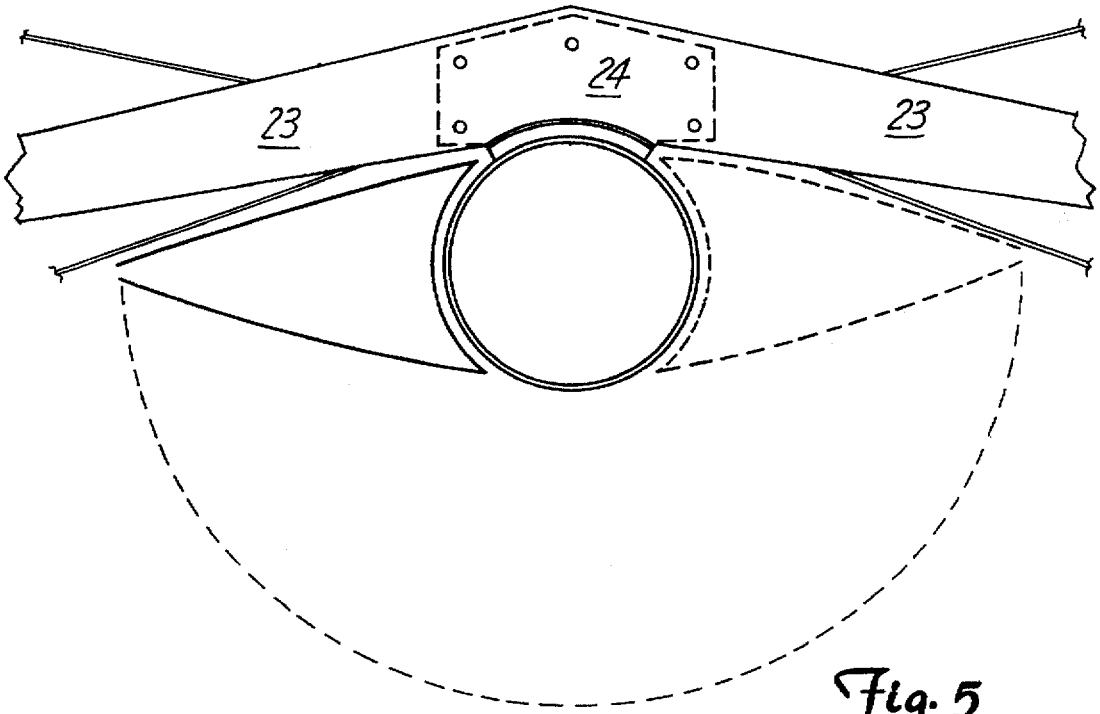
FIG. 5 is the mast viewed from above in a section A—A in FIG. 1.

FIG. 5 illustrates the mast on an enlarged scale viewed from above, from a section through A—A in FIG. 1. The ring with which the profile is attached is not included, nor is the inside of the profile. Through the horns of the crosstrees 23, which are made in one piece, can be seen the stippled attachment bracket 24 to which the horns of the crosstrees 23 are screwed. On the underside on each side of the bottom shrouds can be seen. The profile has been swivelled out the maximum distance to the port side, and the turning sector and the profile's position to starboard are illustrated as dotted lines.

Figure 6:
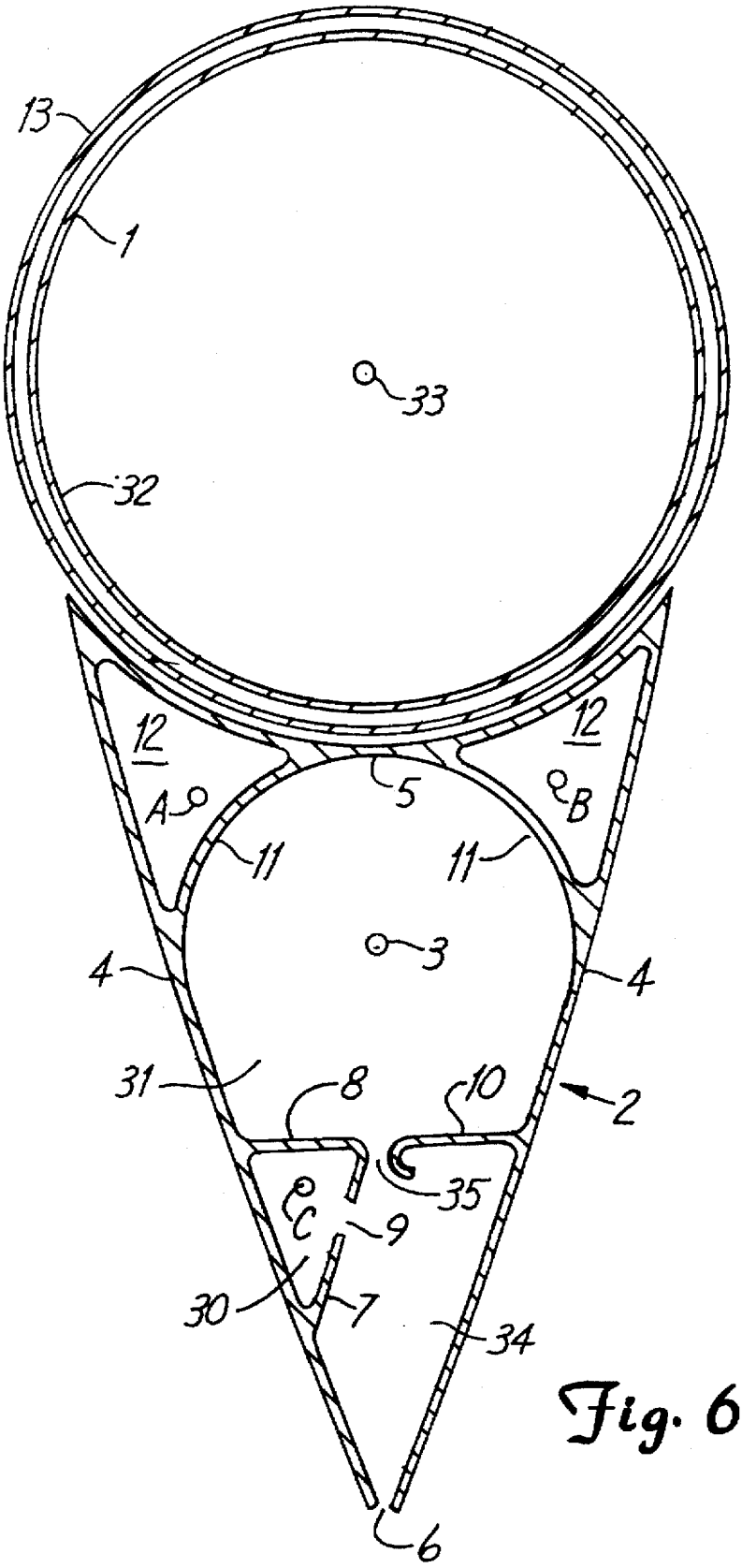
FIG. 6 is a cross section through mast and profile at the intersecting line A—A in FIG. 1.

FIG. 6 shows an enlarged cross section of mast 1 and profile 2 through the intersecting line A—A in FIG. 1. Here a possible design is shown of the interior of the profile intended for use as a roller reeling application. The cross section of the profile 2 has a substantially triangular external shape, where the longest sides 4 are of equal length and slightly convex. The third side 5 is extremely concave corresponding to a sector of a circle, adapted to be permanently mounted on a tubular section, a ring 13. The two longest sides 4 are not connected to each other in the corner between them, but are terminated smoothly and roundedly directly above each other, leaving a slot opening 6, though which the roller sail passes.

On the inside of the profile, some distance from the slot 6, three wall pieces 7,8 and 10 extend from the long sides. The first two form a defined space or a channel 30 with a slot 9 through which an extra mainsail can be mounted. A halyard C for hoisting this sail runs in the channel 30. The walls have smooth surfaces and the slot openings are rounded to permit the sail and the mounting blocks for the extra mainsail to slide easily without becoming worn. The walls 8 and 10 also serve as a rear demarcation of the space 31 for the roller stay 3, and prevent it from being pulled backwards by the traction in the sail when loaded by wind.

The space 31 for the roller stay 3 is defined in front by a semicircular wall 11, which connects the long sides 4 with each other. This wall touches and is "merged" with the concave end wall 5 in the triangle. On each side there is thus formed a new channel 12 defined by the partition wall against the roller stay space 11, the front part of the long side 4 and half of the concave end wall in the triangle. In one of these channels halyard C runs to the extra mainsail hoisted on blocks in the slot 9 and on the opposite side halyard B runs to the roller mainsail which is hoisted on stay 3. Inside the ring 13, whose interior is lined with a hard-wearing sliding coating 32 can be seen the cross section of the mast 1, inside the mast, not shown, runs the boom tricing line, two jib halyards and a spinnaker halyard, in addition to cables for instruments, lanterns, antennas, etc.

As shown in FIG. 6, the outer surface of the mast 1, the short side 5 of the profile 2, and the ring 13 have a substantially identical center of curvature 33. Also as shown in FIG. 6, slot 9 is between channel 30 and a sail exit channel 34, and slot 35 is between sail exit channel 34 and space 31.

The profile is mounted on a base, see FIG. 3, reference number 14, which is mounted against the mast 1 with bearings 36 which absorb both radial and axial forces. Immediately above the base the halyard A for the extra mainsail exits. The halyard B for the roller mainsail exits on the opposite side.

In order for the profile to work, the connections between profile and cockpit must be slack when under sail. Thus full handing of the sails from the cockpit is dependent on a remotely controlled line brake 17 developed for the mast design, and a roller drive gear with stop 15, also remotely controlled.

From the boom comes the sail tricing line 18, passes through a line brake 17, and continues to the cockpit. From the roller drive gear 15 a peripheral line 16 runs to the cockpit. The roller drive gear is equipped with a stop, and from the stop arm at a line 21 goes down to the line brake. The stop arm is actuated from the line brake as a step two in operating this line brake is operated by line 19 which goes to the cockpit.

From the neck of the sail and downwards the rearmost part of the profile's lateral surfaces is cut away into the partition wall against the roller stay space, except for a section 20 between the sail's neck and the boom attachment where the channel for the extra mainsail is kept. From the boom attachment and downwards, the cutting surface and the partition wall with operating are hidden behind a strip which is folded over the corners and attached to the sides of the profile. The roller drive gear 15 is attached to and through this strip.

A version of the profile for a traditional mainsail only, or a mainsail which can be rolled down into the boom, is not illustrated in the drawings, but the cross section of this version of the profile is the same as that shown, apart from the internal design.

The profile has to be capable of being trimmed to the correct position during sailing. The correct angling of the profile in relation to the sail can be achieved by means of several alternative trimming solutions.

Figure 7:
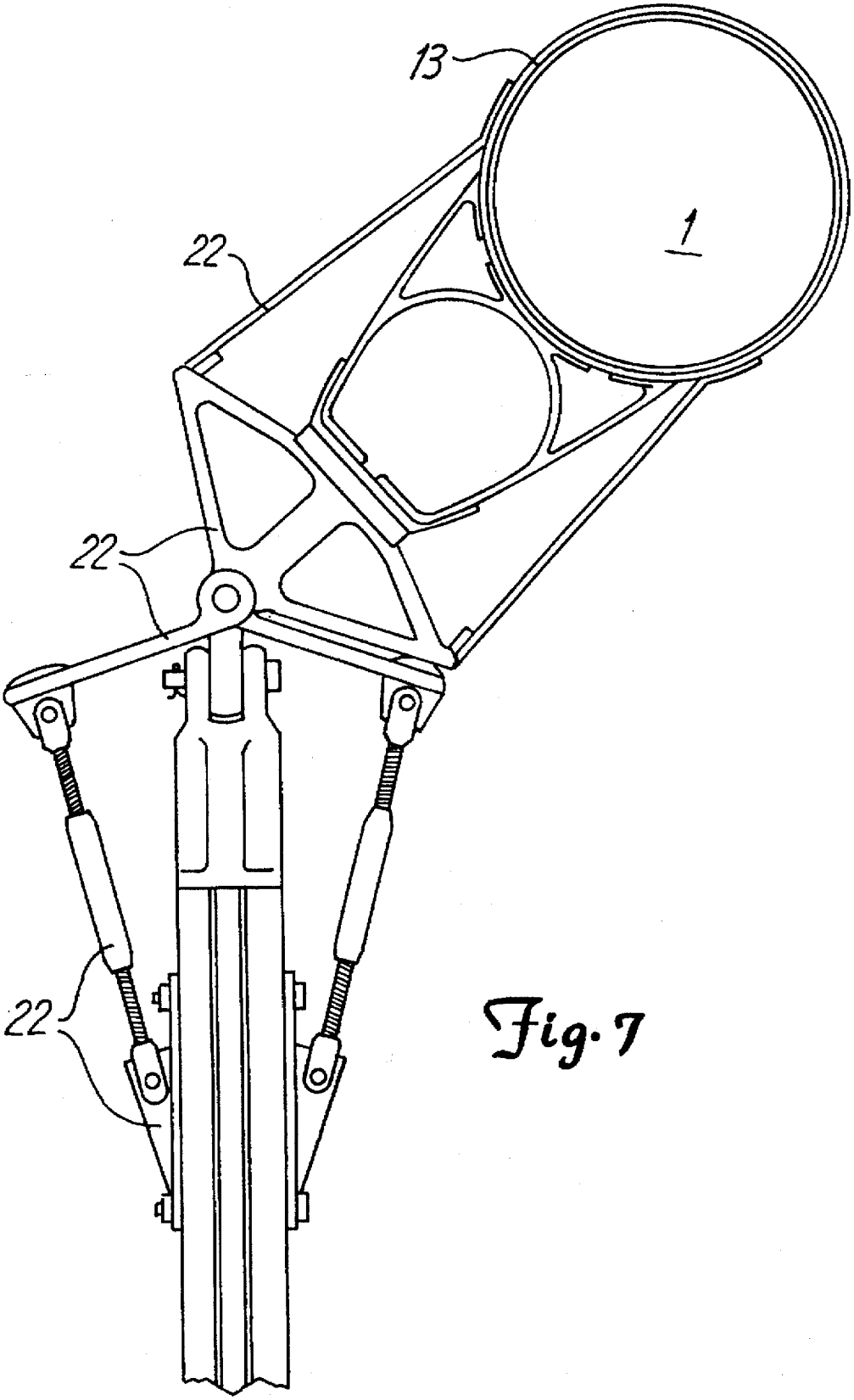
FIG. 7 is a cross section along line D—D in FIG. 3 through boom and mast/profile.

A simple method of trimming the profile can be achieved by using an adjustable angle limiter on the joint between the boom and the profile. See FIG. 3, reference number 22, and FIG. 7 which show the boom and mast/profile as a cross section through D—D in FIG. 3, viewed from above. Here the profile has been swivelled out to the side until the angle limiter 22 stops the swing. The joint must in the direction of the boom where the angle between joint and boom must be of such a size that the tractive power from the joint results in a backwardly directed force component through the boom which is less than the forces which cause angling of the profile. The angle limiter is adjusted by means of turnbuckles to an angular swing which is suited to the depth of the sail. This adjustment is then suitable for all wind directions and joint lengths, but should be adjusted when the depth of the sail is altered. After the profile has reached maximum rotation to the side, longer joint lengths will lead to an increasing deviation between the sail's plane and the profile's plane. This occurs, however, with wind directions where the pressure of the wind against the sail's windward side constitutes the dominant driving force for the boat.

I claim:

1. A mast and profile combination for a sailboat, the mast being of a substantially round shape, the profile being hollow, aerodynamically designed and supported by the mast, the profile being constructed to accommodate a mast rope of at least one sail of the sailboat, the profile comprising:

two long sides, the two long sides being of substantially equal length, the two long sides being slightly convex and terminating at a distance from each other to form a slot opening, the slot opening being constructed to accommodate at least one sail therethrough; and a short side connected to the two long sides, the short side being substantially concave and substantially corresponding to a sector of a circle;

the combination further comprising at least one ring element connecting the profile to the mast to provide rotation of the profile relative to the mast within a sector of about 180 degrees, such that the profile can be positioned at an angle to provide desired tractive power to the sailboat.

2. The combination of claim 1, wherein the profile defines at least one cavity constructed to accommodate a stay for rolling up at least one sail of the sailboat, the profile further defining at least one space constructed to accommodate a halyard for raising at least one sail of the sailboat.

3. The combination of claim 1, wherein edges of the slot opening terminate substantially smoothly and roundedly.

4. The combination of claim 1, wherein the at least one ring element has an external shape fitting the substantially concave short side of the profile, the at least one ring element being secured to the short side of the profile.

5. The combination of claim 1, wherein an inside of the at least one ring element comprises a lining to reduce friction and increase wear resistance, the at least one ring element rotating around the mast to provide rotation of the profile relative to the mast.

6. The combination of claim 1, further comprising a base for bearing the weight of the profile, a lower end of the profile being connected to the base, wherein the base comprises a tube with internal bearings for absorbing axial and radial forces against the mast, the base having an outside portion comprising a footplate and two plate walls for mounting the profile.

7. The combination of claim 1, further comprising:

at least one shroud connected to the mast by a shroud attachment; and crosstrees supported by the mast, the crosstrees having horns, the horns of the crosstrees being of one-piece construction and being slightly angled in a horizontal direction to run in front of the mast, the crosstrees holding the at least one shroud in line with its shroud attachment at the mast.

8. The combination of claim 7, wherein the crosstrees are secured to a bracket, the bracket comprising a curved first plate having a radius of curvature corresponding to a radius of curvature of the mast, the bracket further comprising a second plate extending substantially perpendicularly from the first plate, at least one of the first and second plates comprising a plate projection for attachment to bottom shrouds clear of the front of the mast.

9. The combination of claim 1, wherein the at least one ring element is at least one complete ring surrounding the mast.

10. The combination of claim 1, wherein the at least one ring element comprises a plurality of ring elements spaced along the mast.

11. A mast and profile combination for a sailboat, the mast being of a substantially round shape and having a substantially convex outer surface, the profile being supported by the mast, the profile being constructed to accommodate a mast rope of at least one sail of the sailboat, the profile comprising:

two long sides, the two long sides terminating at a distance from each other to form a slot opening, the slot opening being constructed to accommodate the at least one sail therethrough; and a short side connected to the two long sides, the short side being substantially concave and substantially corresponding to a sector of a circle;

the combination further comprising at least one ring element connecting the profile to the mast to provide rotation of the profile relative to the mast such that the profile can be positioned at an angle to provide desired tractive power to the sailboat, an inside surface of the ring element being of substantially concave shape and corresponding to the substantially convex outer surface of the mast;

wherein the outer surface of the mast, the short side of the profile, and the ring element have a substantially identical center of curvature.

12. The combination of claim 11, wherein the slot opening is constructed to accommodates a first sail of the sailboat therethrough, further wherein an interior of the profile defines a second slot opening, the second slot opening being constructed to accommodate a second sail of the sailboat therethrough.

13. The combination of claim 12, wherein the interior of the profile defines at least two channels for accommodating first and second halyards connectable to the first and second sails, respectively.

14. The combination of claim 11, wherein an interior of the profile defines at least two channels for accommodating halyards.

15. The combination of claim 11, wherein an interior of the profile defines a space for accommodating a roller stay.

16. The combination of claim 15, wherein the interior of the profile comprises a substantially concave wall that at least partially defines the space for accommodating the roller stay, the substantially concave wall facing in a direction away from the mast.

17. The combination of claim 15, wherein the interior of the profile defines a sail exit channel and a channel for accommodating a halyard, the interior of the profile further defining a slot between the sail exit channel and for the channel for accommodating the halyard, the interior of the profile further defining a slot between the sail exit channel and the space for accommodating the roller stay.

18. A mast and profile combination for a sailboat, the combination comprising:

a mast of substantially round shape and having a substantially convex outer surface;

profile means for accommodating a mast rope of at least one sail of the sailboat, the profile means comprising:

two long sides, the two long sides terminating at a distance from each other to form a slot opening, the slot opening being constructed to accommodate the at least one sail therethrough; and a short side connected to the two long sides, the short side being substantially concave and substantially corresponding to a sector of a circle; and ring means for providing rotation of the profile relative to the mast such that the profile can be positioned at an angle to provide desired tractive power to the sailboat, the ring means connecting the profile to the mast, an inside surface of the ring means being of substantially concave shape and being substantially parallel to the substantially convex outer surface of the mast.

19. The combination of claim 18, wherein the outer surface of the mast, the short side of the profile means, and the ring means have a substantially identical center of curvature.

20. The combination of claim 18, wherein the profile means is hollow and aerodynamically designed, further wherein the two long sides of the profile means are of substantially equal length and are of slightly convex shape.

* * * * *